US005400752A

United States Patent [19]

Madeley

[11] Patent Number: 5,400,752

[45] Date of Patent: Mar. 28, 1995

[54] ENGINE PROTECTION VALVE

[75] Inventor: Trevor B. Madeley, Henley On Klip, South Africa

[73] Assignee: Transerve (Proprietary) Limited, Alrode, South Africa

[21] Appl. No.: 168,389

[22] Filed: Dec. 17, 1993

[30] Foreign Application Priority Data

Dec. 18, 1992 [ZA] South Africa ..... 92/9842
Jun. 24, 1993 [ZA] South Africa ..... 93/4540

[51] Int. Cl.[6] ..... F02B 77/00
[52] U.S. Cl. ..... 123/178 DB; 123/41.15
[58] Field of Search ..... 123/198 DB, 41.15, 196 S; 251/63, 63.5; 137/87, 94, 118, 237

[56] References Cited

U.S. PATENT DOCUMENTS 3,590,798 2/1971 Goodwin ..... 123/41.15
4,067,348 1/1978 Davis ..... 123/198 DB
4,476,825 10/1984 Mills ..... 123/198 DB
4,616,806 10/1986 Davis ..... 123/198 DB

*Primary Examiner*—Noah P. Kamen

*Attorney, Agent, or Firm*—Stevens, Davis, Miller & Mosher

[57] ABSTRACT

An engine protection valve to cut off flow of fuel to the engine when oil pressure drops below a predetermined level, comprising a piston 5 slidable in a bore 4 of a housing 2, the piston having a series of seals thereon which divide the bore into three chambers 20, 22, and 24. The chamber 20 has a fuel inlet 6 and a fuel outlet 7, and a valve seat 8 located between the fuel inlet and outlet. A restricted orifice 36 allows a restricted amount of fuel to pass from the chamber 20 to the chamber 22 thereby lubricating the bore 9 of chamber 22 and allowing the seal 16 to slide smoothly on the bore 9. The chamber 22 is kept at atmospheric pressure to enable the valve to operate and fuel to drain from the chamber 22 to the fuel tank through the conduit 40. An alternative arrangement is to lubricate the chamber 9 and seal 16 with engine oil from the chamber 24. The engine oil may be conveyed to the chamber 22 through a passage extending down the stem of the piston where after the oil drains from chamber 22 to a sump.

8 Claims, 3 Drawing Sheets

ENGINE PROTECTION VALVE

BACKGROUND OF THE INVENTION

This invention relates to an engine protection device of the type which is adapted cut off fuel supply to the engine in the event that oil pressure falls below a predetermined value or other parameters of the engine indicating malfunction.

Generally a valve of the aforementioned type is installed into the fuel pipe on the pressure side of the fuel transfer pump between the fuel filters and an injector pump. Typically these valves have three chambers. A high pressure fuel chamber (first chamber), an air chamber (second chamber) that is vented by a breather hole to atmosphere, and an oil chamber (third chamber.) A Spring loaded piston moves within these chambers under the influence of engine oil pressure. Each chamber is separated from the others by seals fitted to the piston or in the body of the valve. Each time the engine starts or stops the piston in the valve moves relative to a valve seat in the chamber to either close off fuel flow through the valve or allow fuel flow to take place. This movement of the piston causes air to be expelled or drawn into the second chamber via the breather hole. This system has a number of disadvantages. Firstly, air which is drawn into the valve, via the breather hole, carries dust and like impurities which settle on seals causing wear. Generally a small filter will be fitted to the breather hole. The filter needs to be replaced regularly but, hi practice, it is found that this is not done and the breather hole becomes clogged which can hamper operation of the valve.

A second problem is that the seals on the piston are unlubricated resulting in high wear and short life. Should one or more of these seals fail, oil and/or fuel is then able to pass into the air chamber from where it exits via the breather hole onto the engine. This can be dangerous and tends to mess the engine.

SUMMARY OF THE INVENTION

According to the invention there is provided an engine protection valve comprising, a valve housing, a first chamber within the housing, a fuel inlet into the first chamber, and a fuel outlet from the first chamber, a valve seat between the fuel inlet and the fuel outlet, a piston-type valve member movable within the chamber between a closed position in which it is in engagement with the seat to close off flow communication between the fuel inlet and the fuel outlet, and an open position in which fuel is able to flow between the fuel inlet and fuel outlet, biassing means for biassing the valve member into the closed position, and operating means adapted to move the valve means into the open position against the influence of the biassing means when oil pressure exceeds a predetermined value, and to allow the valve means to move to the closed position when oil pressure falls below said value, a second chamber separated from the first chamber by an annular seal around the valve member, and means for lubricating the annular seal with either engine oil or fuel.

Preferably the means for lubricating the annular seal comprises restricted orifice linking the first and second chambers, and a bleed outlet from the second chamber adapted to be connected to a fuel tank for the vehicle, the arrangement being such that, in use, fuel will pass from the first chamber to the second chamber through the restricted orifice to lubricate the annular seat, and fuel will drain from the second chamber through the bleed outlet into the fuel tank.

The first and second chambers preferably comprise a co-extending cylindrical bore in the housing and the valve member comprises a piston slidable in that bore. The piston may carry a series of annular seals extending around the periphery thereof spaced apart along the length of the piston. One end of the piston is, in use, preferably exposed to oil under pressure from the engine. In a preferred form of the invention the housing has an oil inlet and an oil outlet and a third chamber is defined between the oil inlet and oil outlet, said one end of the piston defining a wall of said third chamber, the piston being caused to move to its open position when oil pressure within the said third chamber exceeds said predetermined value. The restricted orifice may pass through the valve member.

Alternatively, the second chamber may be connected to a source of high pressure engine oil through as restricted orifice, the second chamber having a bleed outlet to an engine oil sump for the vehicle, the arrangement being such that, in use, engine oil will pass into the second chamber through the restricted orifice; to lubricate the annular seal, and will drain from the second chamber to the sump through the bleed outlet.

Two embodiments of the invention are described in detail in the following passages of the specification which refer to the accompanying drawings. The drawings, however, are merely illustrative of how the invention might be put into effect, so that the specific form and arrangement of the various features shown is not to be understood as limiting on the invention.

DETAILED DESCRIPTION OF PREFERRED EMBODIMENTS

Figure 2:
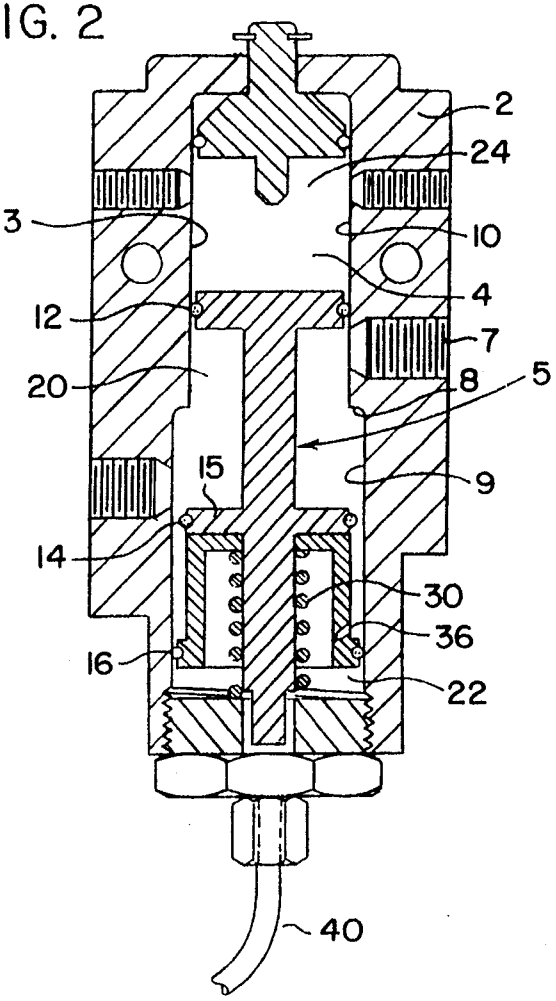
FIG. 2 shows a similar view that FIG. 1 but with the valve in its open position.
Figure 1:
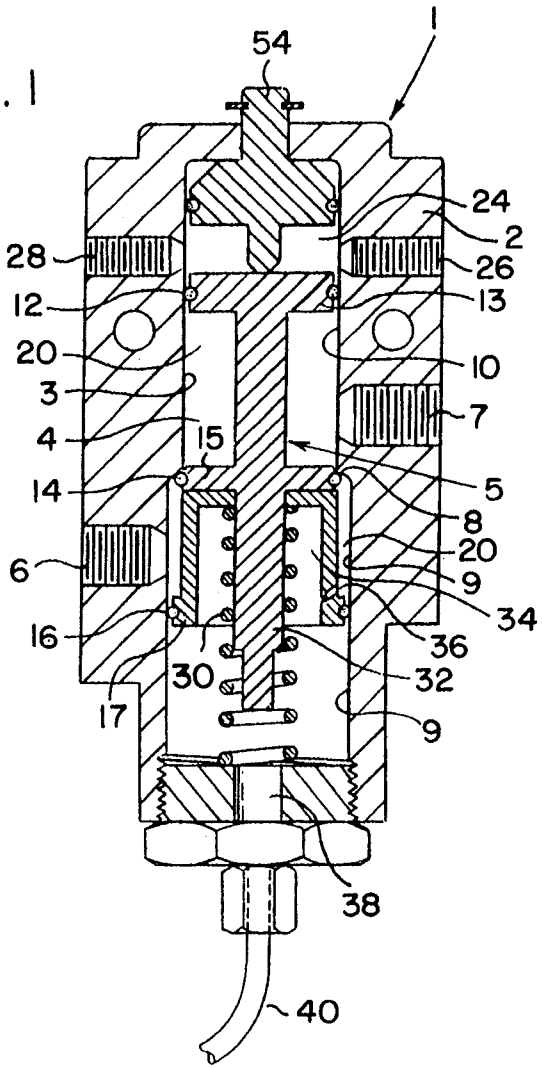
FIG. 1 shows a cross-section side view of an engine protection valve according to the invention with the valve in its closed position.

Referring initially to FIG. 1 and 2 of the drawings, an engine protection valve 1 comprises a housing 2 within which a bore 3 has been formed which defines a central chamber 4 within the housing 2. A piston 5 is movable within the bore 3 between a closed position as shown in FIG. 1 and an open position as shown in FIG. 2. A fuel inlet 6 is formed in the wall of the housing 2 into the chamber 4 and a fuel outlet 7 is provided from the chamber 4. A valve seat 8 is formed in the chamber and that valve seat 8 is located between the fuel inlet 6 and the fuel outlet 7. The valve seat 8 is defined by a shoulder formed in the bore 3 between a wider part 9 of the bore and a reduced part 10 thereof.

The piston 5 has a series of three O-ring seals spaced apart along its length. A first O-ring seal 12 is provided near one end 13 of the piston a second seal 14 is provided near the centre 15 of the piston and a third seal 16 is provided near the other end 17 of the piston. The three seals 12, 14 and 16 divide the chamber 4 into three separate chambers. A first chamber 20 is defined near the center of the housing, a second chamber 22 is defined near the lower end of the housing and a third chamber 24 is defined near the upper end of the housing. Thus, the first chamber 20 is defined between seals 12 and 16, the second chamber 22 is defined below the seal 16 and the third chamber 24 is defined above the seal 12. (The terms "upper" and "lower" are used for designating purposes only and are not intended to imply that the valve 1 must be used in a particular orientation)

The third chamber 24 has an off inlet 26 thereto and an oil outlet 28 therefrom. In use, oil under pressure in third chamber 24 will cause the piston 5 to move from the closed position to the open position. Once in the open position fuel will be able to flow from fuel inlet 6 to fuel outlet 7 through the first chamber 20. A biassing spring 30 is located around a stem 32 of the piston and is housed within a recess 34 within the lower part of the piston 5. That spring 30 acts between the housing 2 and the piston 5 to urge the piston into its dosed position. Oil under pressure in chamber 24 will, on the other hand, urge the piston to move against the action of the spring 30 into its open position indicated in FIG. 2. Thus, if there is an oil pressure drop in chamber 24, the piston 5 will automatically move to its closed position thereby cutting off fuel flow through the valve 1 and preventing continued operation of the engine within which the engine protection valve 1 is located. The manner of the valve's operation will be described below in more detail with reference to FIG. 3 of the drawings.

A restricted orifice 36 is formed in the piston which provides a fuel flow communication between the first chamber 20 and the second 22. The restricted orifice 36 is of relatively small dimensions so that it acts as a jet to spray fuel from the first chamber 20 into the second chamber 22. In use the valve 1 is connected into the fuel system of the engine such that fuel under pressure continuously in the chamber 20, Irrespective of the position of the piston 5 fuel In the first chamber 20 will continuously pass through the restricted orifice 36 into the second chamber 22. The second chamber 22 has a bleed outlet 38 therefrom and a transfer conduit 40 will connect the bleed outlet 38 back to the fuel tank (not shown) of the vehicle. Thus, fuel passing from the first chamber 20 to the second chamber 22 through the restricted orifice 36 will in due course, return to the fuel tank of the vehicle through the conduit 40. The purpose of the fuel spraying through the restricted orifice 36 is to lubricate the second chamber 22 so that, during movement of the piston 5 between its open and closed positions, the seal 16 will continuously slide on a lubricated bore 9. The lubrication will, of course, be provided by fuel passing through the restricted orifice 36 on a continuous basis. The second chamber 22 will be at atmospheric pressure and since the fuel tank of the vehicle will be at atmospheric pressure and the conduit 40 will connect the chamber 22 to that fuel tank Thus, there can be no pressure build up in this chamber 22 which would otherwise influence the operation of the valve. Unlike conventional valves, the chamber 22 is continuously lubricated thereby ensuring smooth operation of the seal 16 and longevity 6f that seal 16.

As shown in FIG. 2, when off pressure in chamber 24 is high, (i.e. above a predetermined level) the piston 5 will be caused to move against the action of spring 30 into its open position, i.e. the position when seal 14 is out of contact with the seat 8. In that position, fuel is able to flow unhindered between fuel inlet 6 and fuel outlet 7. While in operation in this manner fuel under pressure passes between first climber 20 and second chamber 22 through restricted orifice 36 in the manner described above.

Figure 3:
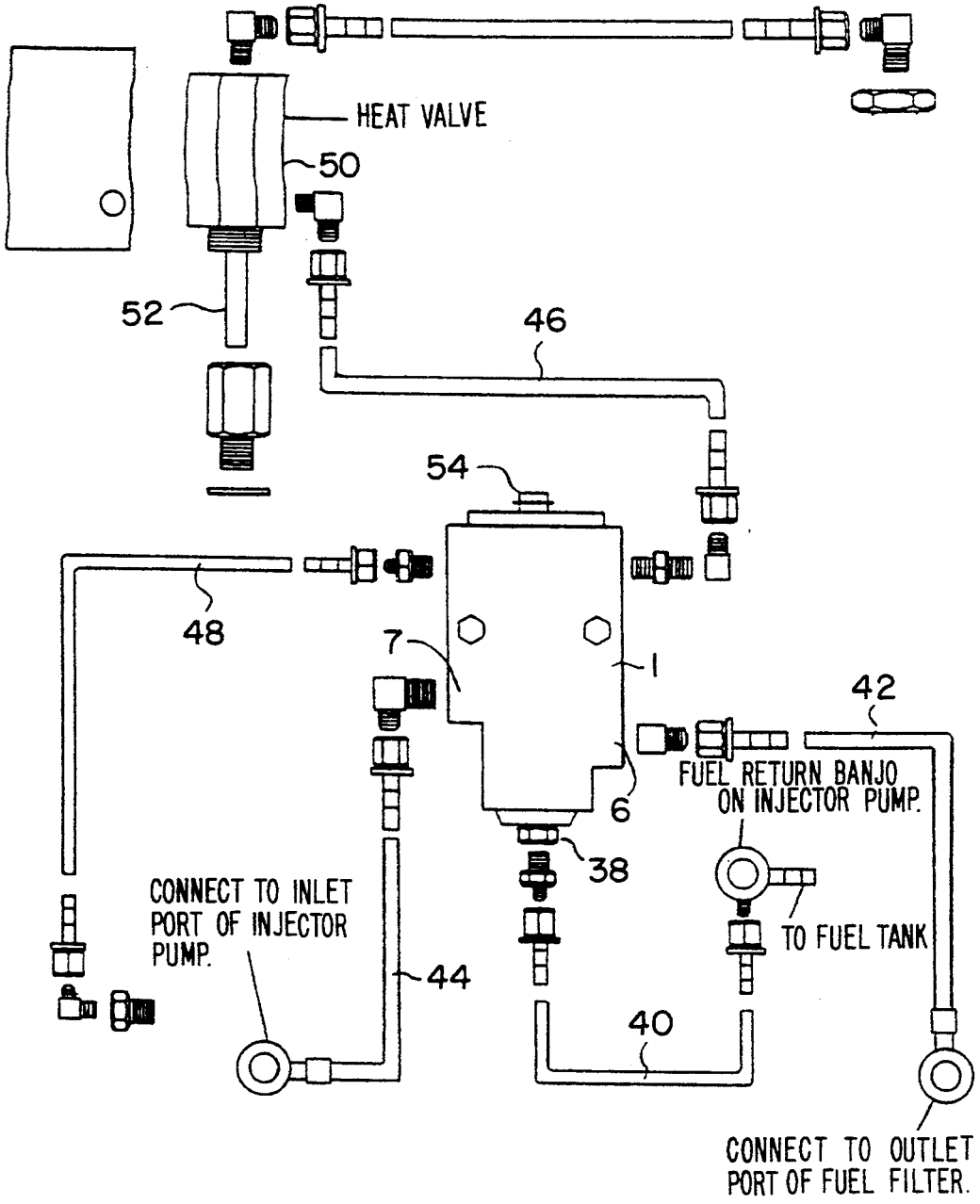
FIG. 3 shows the manner in which the valve of FIGS. 1 and 2 is incorporated into an engine.

Turning briefly to FIG. 3 of the drawings, the manner of connection of the valve 1 into an engine is shown, somewhat diagrammatically. The fuel inlet 6 of the valve 1 is connected to the outlet port from the fuel filter via conduit 42. The fuel outlet 7 from the valve 1 is connected to the inlet port of an injector pump via conduit 44. As previously mentioned the bleed outlet 38 from the valve 1 is connected to the fuel tank via conduit 40. The valve 1 will also be connected via conduits 46 and 48 into the pressurised oil system for the engine. Should oil pressure in conduits 46 and 48 be lost for any reason, the piston 5 will move to its closed position cutting off fuel supply to the injector pump. For example, the engine may have a heat valve 50 which will be adapted to dump off to the crankcase of the vehicle through the conduit 52 in the event that the engine heats up above predetermined temperature. In addition, in the event of engine coolant loss, a second valve (not shown) can be provided to dump oil to the crankcase in the event of engine coolant loss. Thus, any cause of oil pressure loss to the chamber 24 will cause the piston 5 to move to its closed condition thereby shutting off fuel flow to the engine in the manner described. It should be noted that the valve I includes a manually operable override button 54 which, even if off pressure in chamber 24 is below a predetermined value so that the piston 5 is in the closed position, can be depressed to move the piston downwards and the seal 14 off the valve seat 8 thereby allowing fuel to flow from inlet 6 to outlet 7, It will be appreciated that the second chamber 22 is not vented directly to atmosphere so that the problems mentioned earlier of the ingress of dust and the like into the valve, are avoided. Likewise, the problems associated with the air filter into the chamber 22 are avoided. Since no air filter is required there is no need to regularly replace any filter and the maintenance of the valve is thereby simplified.

Figure 4:
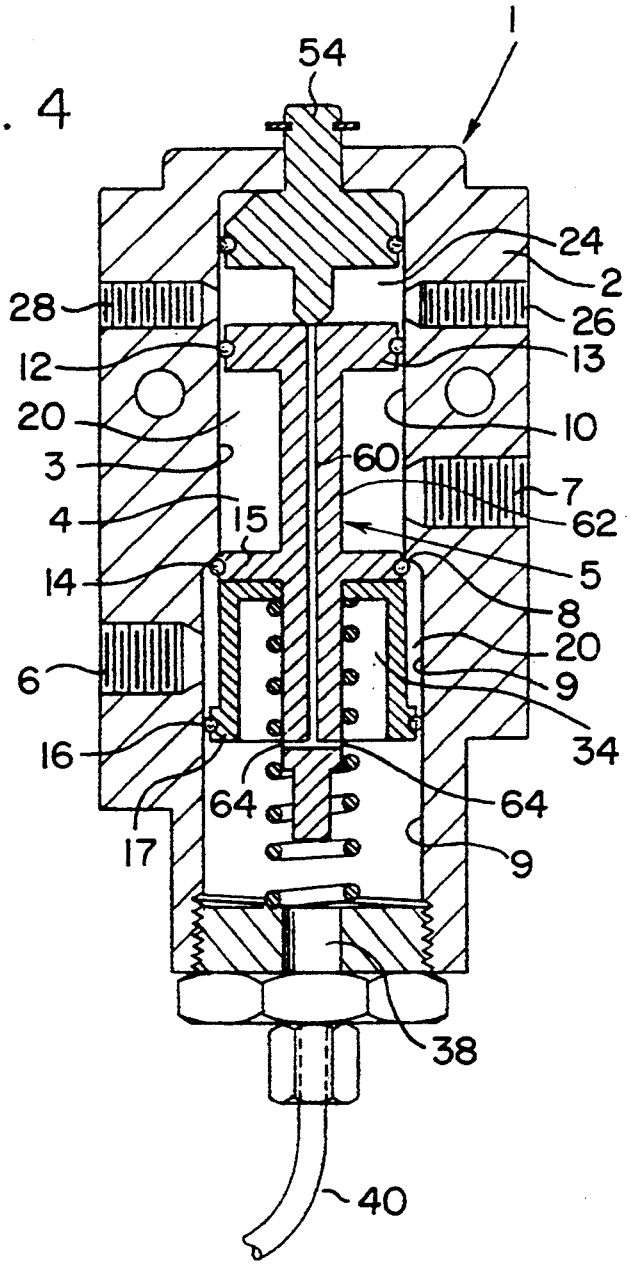
FIG. 4 shows a similar view to that of FIG. 1 of a second embodiment of the invention.

An alternative embodiment of the invention is shown in FIG. 4 of the drawings. In this embodiment there is no connection between the first and second chambers. However, a passage 60 connects the third chamber 24 to the second chamber 22. The passage 60 passes down the stem 62 of the piston and is of narrow dimensions so that flow of engine oil through the passage 60 is restricted. The engine oil will spray into the chamber 22 through outlet nozzles 64 thereby lubricating the bore 9 of the chamber to allow smooth sliding of tile seal 16 in the bore 9. The chamber 22 will remain at atmospheric pressure and oil will drain through outlet 38 and conduit 40 to a convenient sump in the engine Many variations may be made to the above described embodiment without departing from the scope of the invention. In particular, the arrangement of the various chambers and the configuration of the bore and piston can vary quite considerably. However, the advantage having a restricted orifice in the piston so that the "air chamber" of the valve is lubricated provides advantages for the valve which enables the valve to operate smoothly for a lengthy period of time without requiring replacement of seals. With suitable adaption the annular seals can be mounted in annular recesses in the cylinder bore rather than on the piston.

I claim:

1. An engine protection valve comprising, a valve housing, a first chamber within the housing, a fuel inlet into the first chamber, and a fuel outlet from the first chamber, a valve seat between the fuel inlet and the fuel outlet, a piston-type valve member movable within the chamber between a closed position in which it is in engagement with the seat to close off flow communication between the fuel inlet and the fuel outlet, and an open position in which fuel is able to flow between the fuel inlet and fuel outlet, biassing means for biassing the valve member into the closed position, and operating means adapted to move the valve means into the open position against the influence of the biassing means when oil pressure exceeds a predetermined value, and to allow the valve means to move to the closed position when oil pressure falls below said value, a second chamber separated from the first chamber by an annular seal around the valve member, and means for lubricating the annular seal with either engine oil or fuel, comprising a restricted orifice linking the first and second chambers, and a bleed outlet from the second chamber adapted to be connected to a fuel tank for the vehicle, the arrangement being such that, in use, fuel will pass from the first chamber to the second chamber through the restricted orifice to lubricate the annular seal, and fuel will drain from the second chamber through the bleed outlet into the fuel tank.

2. An engine protection valve according to claim 1 wherein the first and second chambers comprise a co-extending cylindrical bore in the i housing and the valve member comprises a piston slidable in that bore.

3. An engine protection valve according to claim 2 wherein the piston carries a series of annular seals extending around the periphery thereof and spaced apart along the length of the piston.

4. An engine protection valve according to claim 3 wherein one end of the piston is exposed to off under pressure from the engine.

5. An engine protection valve according to claim 4 wherein the housing has an oil inlet and an oil outlet and a third chamber is defined between the oil inlet and oil outlet, said one end of the piston defining a wall of said third chamber, the piston being caused to move to its open position when oil pressure within the said third chamber exceeds said predetermined value.

6. An engine protection valve according to claim 1 wherein the restricted orifice passes through the valve member.

7. An engine protection valve comprising, a valve housing, a first chamber within the housing, a fuel inlet into the first chamber, and a fuel outlet from the first chamber, a valve seat between the fuel inlet and the fuel outlet, a piston-type valve member movable within the chamber between a closed position in which it is in engagement with the seat to close off flow communication between the fuel inlet and the fuel outlet, and an open position in which fuel is able to flow between the fuel inlet and fuel outlet, biassing means for biassing the valve member into the closed position, and operating means adapted to move the valve means into the open position against the influence of the biassing means when oil pressure exceeds a predetermined value, and to allow the valve means to move to the closed position when oil pressure falls below said value, a second chamber separated from the first chamber by an annular seal around the valve member, and means for lubricating the annular seal with either engine oil or fuel, said second chamber being connected to a source of high pressure engine oil through a restricted orifice, the second chamber having a bleed outlet to an engine oil sump for the vehicle, the arrangement being such that, in use, engine oil will pass into the second chamber through the restricted orifice to lubricate the annular seal, and will drain from the second chamber to the sump through the bleed outlet.

8. An engine protection valve according to claim 7 wherein the restricted orifice passes through the valve member.

* * * * *